US005230566A

United States Patent [19]

Jackson et al.

[11] Patent Number: 5,230,566

[45] Date of Patent: Jul. 27, 1993

[54] PORTABLE WATER BAG

[76] Inventors: George M. Jackson, 1657 S. 13th St. West; Stuart E. Putnam, Jr., 3420 W. Central Ave., both of Missoula, Mont. 59801

[21] Appl. No.: 909,263

[22] Filed: Jul. 6, 1992

[51] Int. Cl.[5] ..... B65D 33/01

[52] U.S. Cl. ..... 383/66; 383/41; 383/111; 383/113; 383/906; 224/148; 224/235

[58] Field of Search ..... 383/41, 66, 87, 111, 383/113, 901, 906; 224/148, 235, 236, 246

[56] References Cited

U.S. PATENT DOCUMENTS

| | | | |
|---|---|---|---|
| 1,576,488 | 3/1926 | Hodgson | 383/901 X |
| 1,959,782 | 5/1934 | Fenwick, Jr. | 383/41 X |
| 2,119,490 | 5/1938 | Pellerin | 383/87 |
| 3,422,867 | 1/1969 | Wu | 383/66 |
| 3,638,835 | 2/1972 | Goodrich et al. | 222/107 |
| 4,165,024 | 8/1979 | Oswalt et al. | 222/105 |
| 4,213,549 | 7/1980 | Hibbard | 224/236 X |
| 4,378,069 | 3/1983 | Franco | 206/620 |
| 4,420,097 | 12/1983 | Motsenbocker | 224/148 X |
| 4,586,628 | 5/1986 | Nittel | 220/470 |
| 4,601,410 | 7/1986 | Bond | 222/92 |
| 4,627,554 | 12/1986 | Leibinsohn | 224/148 X |
| 4,672,688 | 6/1987 | Kalkipsakis | 383/58 |
| 4,688,643 | 8/1987 | Carter et al. | 224/148 X |
| 4,836,416 | 6/1989 | Shalgi et al. | 383/906 X |
| 4,893,731 | 1/1990 | Richter | 222/92 |
| 4,960,227 | 10/1990 | Coleman | 222/94 |
| 4,976,262 | 12/1990 | Palmacci | 383/901 X |
| 5,115,947 | 5/1992 | McDonnell et al. | 383/33 X |

*Primary Examiner*—Allan N. Shoap
*Assistant Examiner*—Jes F. Pascua
*Attorney, Agent, or Firm*—M. Howard Silverstein; John D. Fado; Janet I. Stockhausen

[57] ABSTRACT

A bag for containing liquids comprising a flexible outer shell and a flexible inner liner. The outer shell has attachment access points and transport straps attached to it. The liner consists of a flexible material with at least one spout which extends through corresponding access points in the outer shell. A flap in the outer shell provides for easy insertion and removal of the liner.

3 Claims, 5 Drawing Sheets

PORTABLE WATER BAG

BACKGROUND OF THE INVENTION

1. Field of the Invention

The present invention relates in general to flexible containers with liners used for transporting liquids, and in particular to land vehicle- and helicopter-transportable bags with a flexible reusable liner for transporting liquids.

2. Description of the Prior Art

A problem encountered in many remote areas without water resources is obtaining both potable and nonpotable liquids. One example of this problem is the lack of potable water near personnel fighting wild land fires. Wild land fires are often fought in remote areas not accessible by roads. Furthermore, personnel are often in terrain which makes overland transportation of water extremely time and energy consuming. The present invention, unlike prior inventions, is particularly suited for solving this problem.

The U.S. Pat. No. 4,378,069 issued to Franco on Mar. 29, 1983, for "Pouch With Pour Spout" discloses a laminated plastic pouch with a single pour spout. The top of the pour spout is designed to fracture when a radially inwardly directed force is applied to the sidewalls of the spout. This fracturing, however, makes the pouch non-reusable and may make it not suitable for rugged environments.

The U.S. Pat. No. 4,960,227 issued to Coleman on Oct. 2, 1990, for "Bulk Material Container With A Flexible Liner" discloses a nonflexible outer shell with a flexible liner. The bottom of the liner has an outlet at the bottom which connects to an outlet assembly at the bottom of the outer shell. This outlet assembly includes a valve and tubing and is designed to be connected to a device, such as a vacuum pump, for withdrawing the bulk material from the liner. Such an elaborate system is not practical for dispensing water in the wild land fire environment.

SUMMARY OF THE INVENTION

It is an object of the present invention to provide a reusable land vehicle- and helicopter-transportable water bag which enables the user to transport liquids, particularly potable and nonpotable water, into areas which do not have immediate access to sources for the liquids or water. The size of the bag could range from 10 gallon to 300 gallon capacities.

It is also an object of the present invention to provide a water bag with a replaceable liner, thereby allowing the user to simply change the liner, rather than replacing the entire bag when damage occurs, potable water quality becomes questionable, or the user wants to switch from transporting potable water to transporting non-potable water.

It is another object of the present invention to provide a water bag which has a long service life, low cost for procurement and low cost for storage until reissuance is required.

It is yet another object of the present invention to provide a water bag that can be easily and inexpensively refurbished and repaired. If, for example, the outer shell and liner were to be punctured, the potable water liner could be discarded and replaced while the outer shell need simply be patched. Nonpotable water bags could also be repaired and refurbished.

The present invention comprises a land vehicle- and helicopter-transportable outer shell with a reusable liner. The shell is roughly rectangular in shape and is constructed of 14 oz. nylon duck or a similar material which is able to withstand being transported from a helicopter into a primitive site without breakage. The shell may be color-coded to enable users to quickly identify whether the liquid in the shell is potable or nonpotable. A pocket, which can be made of the same material as the shell, is optionally attached to the top of the shell to allow accessory items, such as spare liners and drain hoses, to be transported along with the shell. The shell is constructed from a single sheet of material and folded such that one end overlaps the other on the top of the bag. This overlapping creates a flap on the bag through which the liner can be inserted. The end of the flap can be fastened to the bag by means of a buckle, thereby ensuring the liner is secure inside the shell.

The top of the shell also contains at least one, but more preferably multiple, circular access points so that spouts attached to the liner can be inserted through the access points, thereby allowing the water to be released from the bag without removing the liner from the shell.

Additionally, two straps can be securely attached to the bottom of the shell to facilitate transporting the bag. Each end of each strap extends beyond the shell, one end at each corner, and can be sewn to a sturdy ring so that the shell can be easily attached to a helicopter or other vehicle.

The liner is constructed of a flexible plastic or similar material of sufficient strength to withstand the forces exerted upon it and has multiple cylindrical spouts positioned such that each spout can be extended through one of the access points in the outer shell. Each spout is also constructed with a mating cap which, when secured to the spout, creates a sealed storage volume. The liner is sized larger than the shell to ensure the overall strength of the water bag is defined by the outer shell.

DETAILED DESCRIPTION OF THE PREFERRED EMBODIMENT

Figure 1:
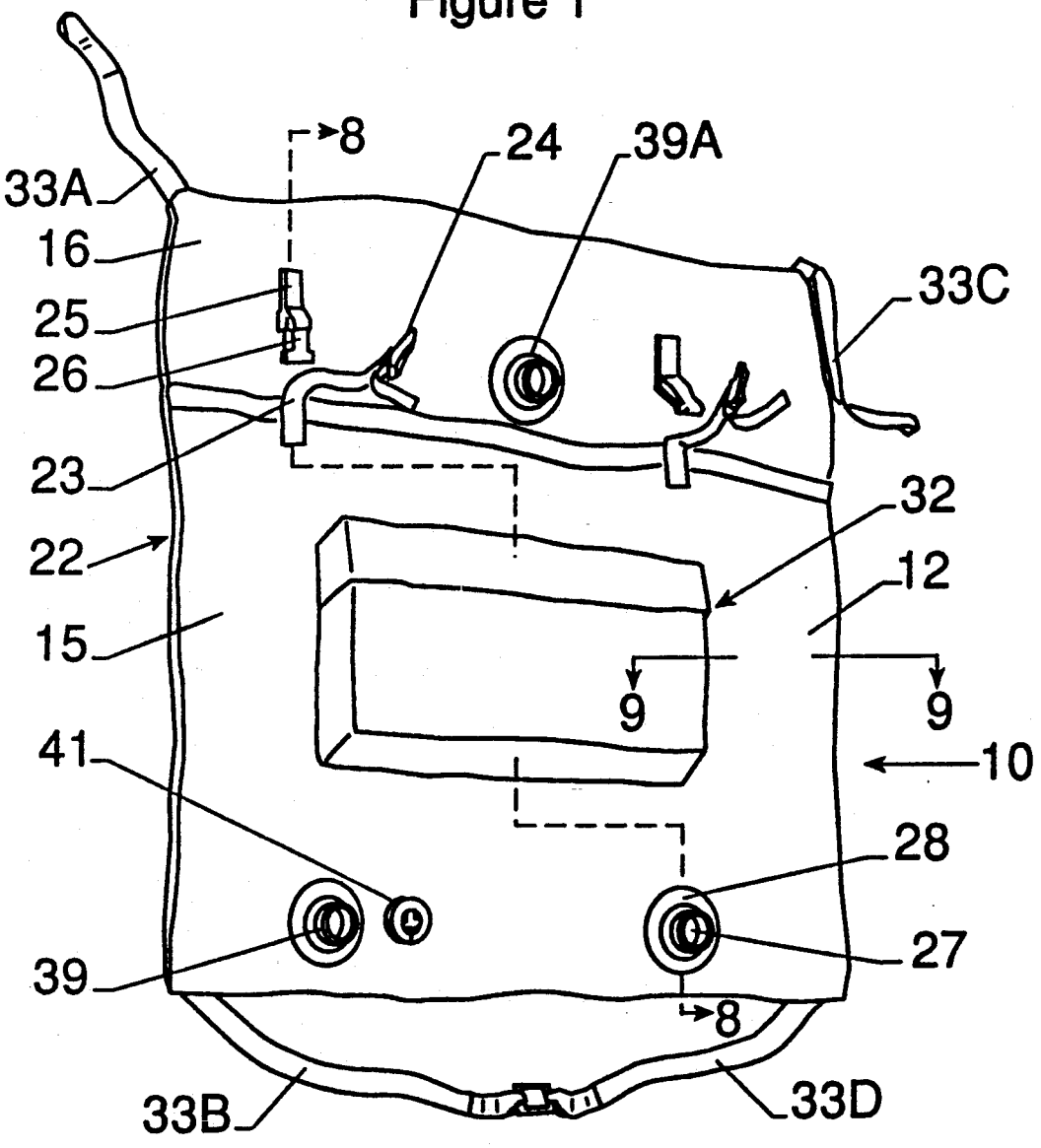
FIG. 1 is a top perspective view of the present invention.
Figure 2:
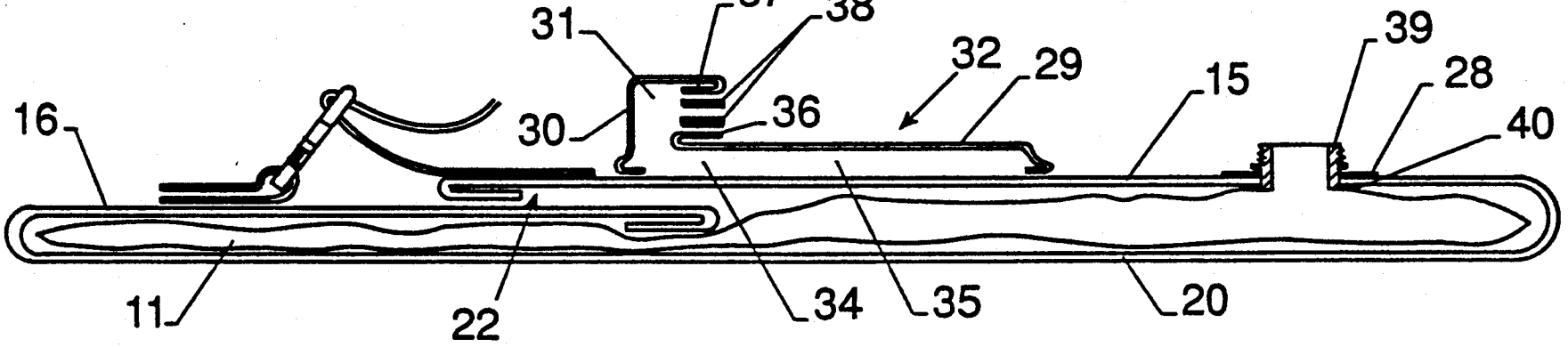
FIG. 2 is a cross-sectional view along the line 8—8 of FIG. 1.

A water bag 10 with a flexible outer shell 12, a pocket 32, and transport straps 33 is shown in FIG. 1. A reusable flexible liner 11, inside the water bag, is shown in FIG. 2.

Figure 3:
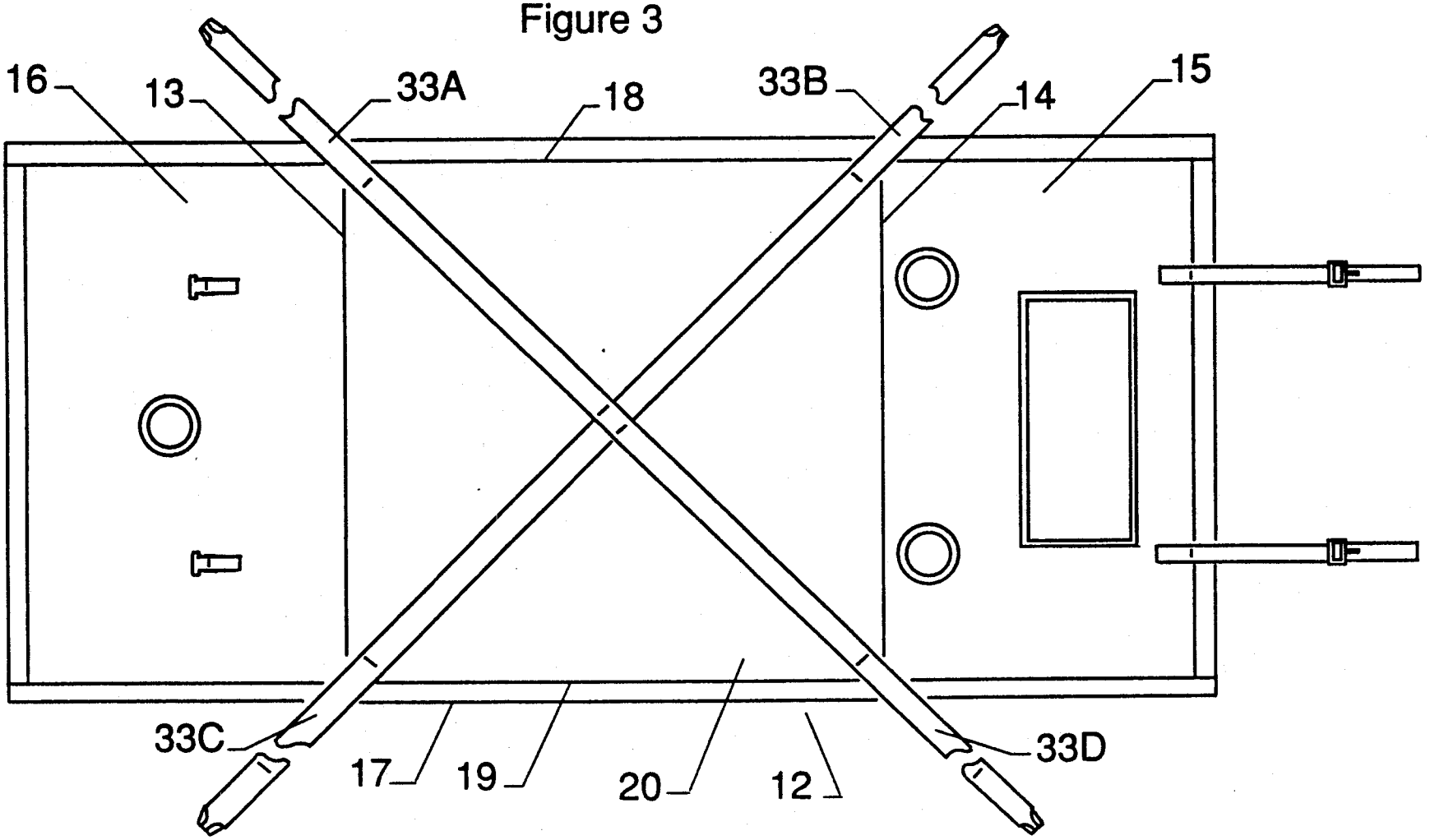
FIG. 3 is a bottom plan view of the present invention.
Figure 5:
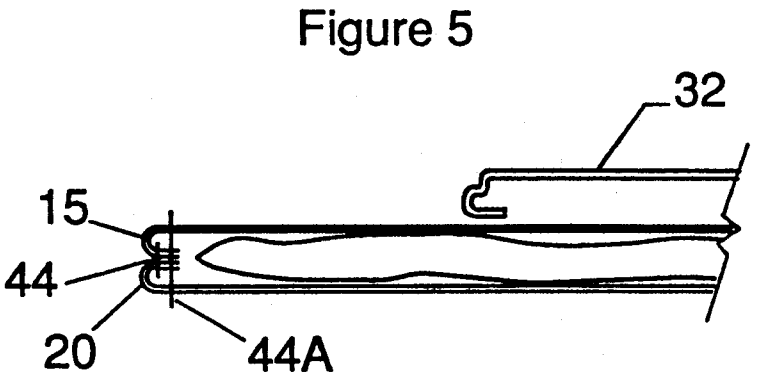
FIG. 5 is a cross-sectional view along the line 9—9 of FIG. 1.

The outer shell 12 may be constructed from a single sheet 17 of 14 oz. nylon duck or similar material as shown in FIG. 3. The sheet 17 is first folded at crosswise fold lines 13 and 14 in such a way that first top piece 15 overlaps second top piece 16 as shown in FIG. 2, creating a flap 22. The two longer edges of sheet 17, which are substantially perpendicular to fold lines 13 and 14, are then folded inwardly along lengthwise fold lines 18 and 19 as shown in FIG. 5. This results in the inner folded areas of first top piece 15 and second top piece 16 facing the inner unfolded area of bottom piece 20 as shown in FIG. 2. The relationship of top piece 15 to bottom piece 20 is shown in cross-section in FIG. 5 wherein they are secured to each other by means of stitching or other suitable means 44. In the alternative, stitching 44A, in which the stitching secures four layers of material rather than just two layers, could be used in place of or in addition to stitching 44. The bottom folded area is then secured to the facing top folded areas along the entire length of the bottom piece 20 except for the area where top piece 15 overlaps top piece 16. Neither flap 22 nor the portion of top piece 16 directly below flap 22 is secured to bottom piece 20 to allow for the insertion of flexible liner 11. The preferred embodiment is for this securing to be accomplished by stitching with thread, for example nylon size FF thread. However, heat sealing and ultrasonic sealing can also be used. This creates an enclosed storage area 21 which can be accessed through the flap 22 as shown in FIG. 2.

Alternatively the outer shell 12 could be constructed of three separate sheets of material sealed together along the edges as described above. The preferred embodiment of a single sheet, however, provides a shell 12 with greater strength and lower manufacturing costs.

The flap 22 can be fastened to top piece 16 to ensure the contents of the shell 12 are secure in the storage area 21. The preferred embodiment of this fastening mechanism is shown in FIG. 1. Two straps 23 are secured to the flap 22 by means of stitching. Each strap 23 is then connected to a connecting means 24, for example a buckle, which is constructed of acetal plastic or other similar material. Each connecting means 24 is then inserted into or attached to a mating connecting means 26, also constructed of acetal plastic or similar suitable material. The connecting means 26 are securely attached to straps 25 which are secured to top piece 16 by means of stitching. The user can adjust the effective length of a strap 23 by moving the connecting means 24 along the strap 23. This allows the user to ensure flap 22 is tightly secured.

The outer shell 12 also contains multiple circular access points 27 on top pieces 15 and 16. The preferred embodiment shows three such access points, however the present invention includes embodiments which increase or decrease the number of such access points. Each access point 27 is surrounded by a reinforcement ring 28 as shown in FIG. 1. Each reinforcement ring 28 is constructed of a sturdy material, such as 40 mil vinyl chloride, and is attached to the shell 12 by means of stitching or other suitable means. The diameter of each access point 27 is equal to the diameter of the inner portion of the reinforcement ring 28.

The preferred embodiment also shows a pocket 32 attached to shell 12. The pocket 32 may be attached to top piece 15 of shell 12 in a variety of ways such as stitched, glued, heat sealed, ultrasonically sealed or any other suitable method. This pocket may be constructed of the same material as the outer shell 12. The pocket 32, as shown in the drawings, is constructed by using two sheets of the appropriate material which are roughly rectangular in shape and are unequal in size, however, the pocket size and shape could be adapted to accommodate the intended use of the pocket so these factors could vary. The pocket could be used to carry items such as, but not limited to, patch kits, fittings and drainage hoses, or an extra liner 11. The larger sheet 29 is attached to the outer shell 12 along three sides, thereby creating a storage volume 35 with an open end 34 as shown in FIG. 2. The smaller sheet 30 is also attached to the outer shell 12 along three sides with the open end 31 facing the open end 34 of sheet 29. Once attached to shell 12, a storage area is also created in the interior of the smaller sheet 30.

The edges 36 and 37 along the open ends of sheets 29 and 30, respectively, are connected together by means of a fastening device. The preferred embodiment of the fastening device is a zipper 38 which ensures the contents of the pocket 32 are secure. Other suitable fastening devices may include velcro, snaps, buttons or hooks.

Figure 4:
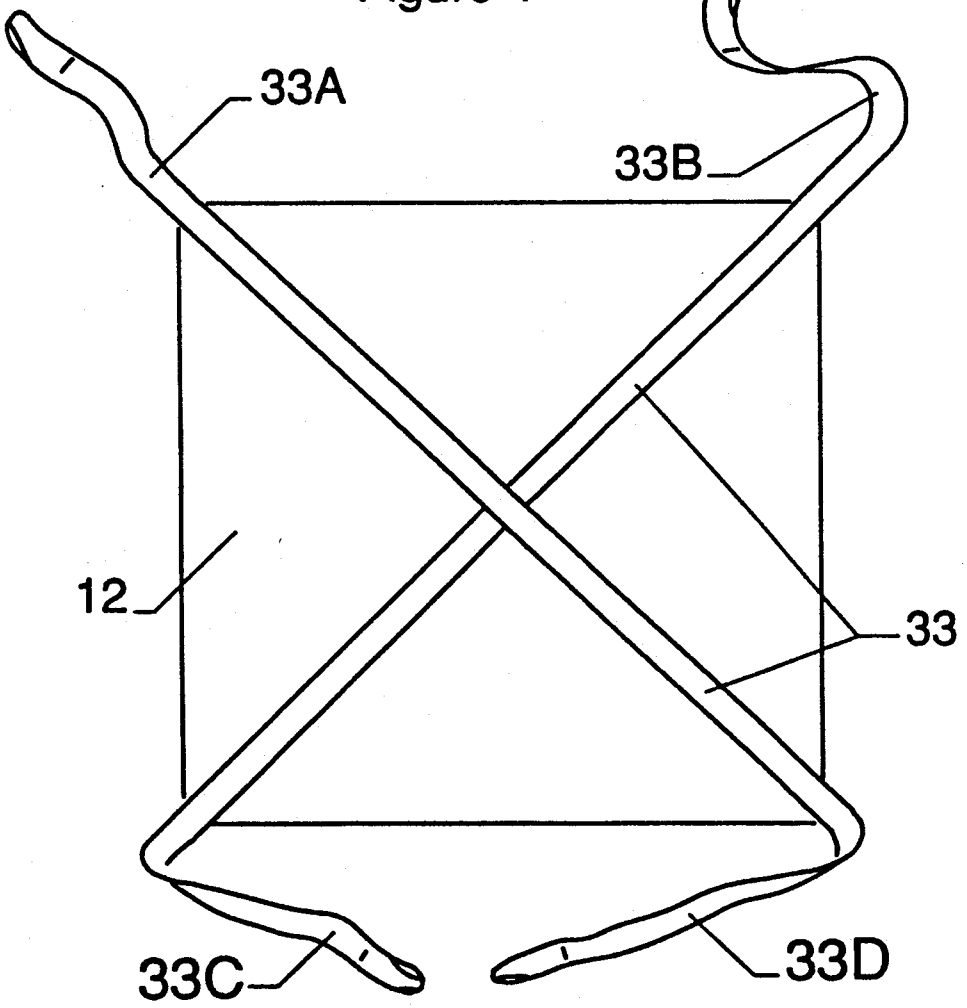
FIG. 4 is a bottom perspective view of the present invention.

The outer shell 12 also has two transport straps 33 attached to the shell on the bottom piece 20 by means such as stitching, as shown in FIG. 3. The straps 33 are constructed of nylon or other suitable material and are arranged on the shell 12 such that when the bag is set down on a solid surface with the straps 33 fully stretched out, the ends 33A, 33B, 33C and 33D extend beyond the shell 12 at each corner. The two straps 33 intersect on the bottom of the shell 12 as shown in FIG. 4. If the straps 33 are sewn, then a preferred embodiment could be to take the end of each strap 33, pass it through a sturdy ring, fold it back onto itself, and then stitch it to itself along the entire area of this fold. Sturdy rings may be of any size suitable to accommodate the size of the water bag, for example a 55 gallon water bag may use metal rings having an inner diameter of 4 inches and an outer diameter of 5 inches. Alternatively, bags can be constructed without the straps and then can be transported by a helicopter in an external load net.

The outer shell 12 houses a flexible liner 11 constructed of 12 mil PVC or PE plastic or similar material as shown in FIG. 2. The liner 11 is a sealed storage volume suitable for containing liquids. The liner 11 is sized larger than the outer shell 12 to ensure the overall strength of the water bag 10 is defined by the outer shell 12, rather than the liner 11.

The liner 11 contains at least one, but may have multiple, spout 39 as shown in FIG. 2. Each spout 39 is generally cylindrical in nature, open on either end, and has a diameter smaller than the diameter of each access point 27 in shell 12. These spouts allow the user to remove the contents of liner 11 without removing the liner 11 from the outer shell 12. Ideally, the number of spouts 39 attached to liner 11 will correspond to the number of access points 27 in the outer shell 12. The spouts 39 are positioned such that when the liner 11 is properly inserted into the shell 12, the spouts 39 extend through each access point 27 of the outer shell 12.

The end of each spout 39 which is in contact with the liner 11 forms a flange 40. The flange 40 may be secured to the liner 11 by any adhesion process, preferably being heat sealed.

Figure 6:
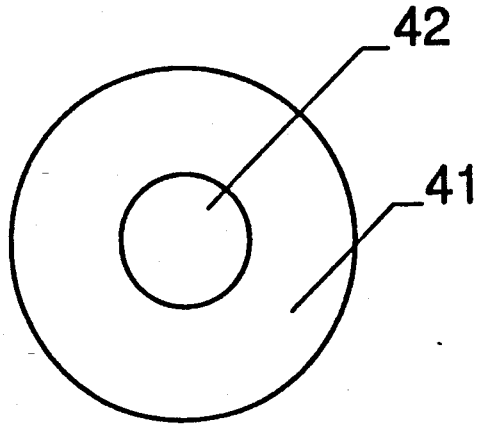
FIG. 6 is a top view of a cap.
Figure 7:
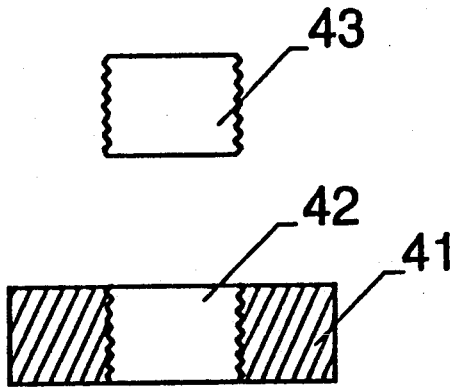
FIG. 7 is a cross-sectional view of a cap and plug.

The end of each spout 39 which extends through the access points 27 in the outer shell 12 is constructed such that a cap 4 can be placed on the spout 39 as shown in FIG. 1. The preferred embodiment shows a spout 39 which is threaded on the exterior surface of its sidewalls. The cap 41 contains a mating thread on the interior surface of its sidewalls so that the cap 42 can be screwed on to the spout 39. The cap 41 has a circular opening at its center which creates a cylindrical access point 41 as shown in FIG. 6. The interior surface of the access point 42 is threaded such that a plug 43 with a mating thread can be secured in the access point 42 as shown in FIG. 7.

Liquids may be inserted into the liner 11 through the spout 39. The spout 39 may have a sturdy hardware piece attached to it to reduce the risk of contaminating the contents of the liner 11 during filling, as shown in FIG. 1. To insert liquids into the liner 11, a plug 43 is removed from a cap 41. Tubing, which is threaded identically to plug 43, is then attached to the cap 41.

Alternatively, liquids can be inserted into the liner 11 by removing the cap 41 from one of the spouts 39. If the location where the liner is being filled is suitable, multiple caps 41 could be removed allowing the user to fill the bag more quickly. The user may introduce the liquid to the liner 11 by any suitable means, such as holding a spout 39 up to a nozzle or similar liquid source, inserting a tube into the liner 11 through spout 39 with the opposite end of the tube being attached to a liquid source, or immersing the liner 11 in a liquid source and allowing the liquid to flow into the liner 11 through the open spout 39.

Removing liquids from the liner 11 is similar to inserting liquids into it. A single cap 41, or multiple caps if the user so desires, is removed from a spout 39. Alternatively, a plug 43 could be removed from a single, or multiple, cap 41 to gain access to the liquid. The user can then remove the liquids by any available means, such as lifting the bag and allowing the contents to drain out through the open spout 39, or inserting a tube into liner 11 and directing the liquid to the desired location. The user is given the freedom to remove as much of the liquid from the bag as is desirable. Liquid can be stored in the liner 11 for future use or transported to another location.

While the present invention is shown in its preferred embodiment in FIGS. 1–7, this is done for illustration purposes only. Many alterations could be made, including changes in materials, shape of the bag or spouts, or fastening mechanisms which still maintain the spirit of the invention.

What is claimed is:

1. A sturdy, flexible bag for liquid transport comprising:

(a) a single rectangular sheet folded twice along lines running parallel to the two shorter sides of said rectangular sheet, thereby creating a first part and a second part which lay on a third part, such that said first part overlaps said second part;

(b) means to secure said first and second parts to said third part along the edges of all three parts so as to provide a substantially enclosed bag having access to its interior through said overlap;

(c) said first and second parts having at least one connecting means attached to said parts, said connecting means acting to securely seal said overlap when said bag is in use;

(d) said bag having at least two access points, one located in one of said first and second parts, and the other point located in another of the first and second parts;

(e) a removable flexible inner liner capable of containing liquids having access points corresponding to said access points of said bag;

(f) the access points on said liner being spaced in all direction from said overlap; and (g) said access points on said bag being small enough in size so that said inner liner can not pass therethrough.

2. A flexible inner liner as claimed in claim 1 comprising:

(a) a sealed storage volume, (b) at least two pour spouts attached to said sealed storage volume;

(c) said spouts being positioned such that each spout corresponds with an access point in said bag.

3. A sturdy, flexible bag comprising:

(a) a first sheet;

(b) a second sheet;

(c) a third sheet;

(d) said sheets being of substantially identical widths;

(e) said first sheet and said second sheet being of lengths such that when laid flat on said third sheet said first sheet overlaps said second sheet;

(f) said first sheet and said second sheet being secured to said third sheet along the edges of said first sheet and said second sheet except for the edge where said first sheet overlaps said second sheet thereby creating said bag having a storage volume;

(g) said first and second sheets each having at least one connecting means attached to said sheets, said connecting means acting to securely seal said overlap when said bag is in use;

(h) said bag having at least two access points, one located in one of said first and second parts, and the other point located in another of the first and second parts;

(i) a removable flexible inner liner capable of containing liquids having access points corresponding to said access points of said bag;

(j) the access points on said liner being spaced in all directions from said overlap; and (k) said access points on said bag being small enough in size so that said inner liner can not pass therethrough.

* * * * *